US007057568B2

(12) United States Patent
Louzir et al.

(10) Patent No.: US 7,057,568 B2
(45) Date of Patent: Jun. 6, 2006

(54) DUAL-BAND ANTENNA WITH TWIN PORT

(75) Inventors: Ali Louzir, Rennes (FR); Philippe Minard, Saint Medard sur Ille (FR); Dominique Lo Hine Tong, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 20 days.

(21) Appl. No.: 10/876,219

(22) Filed: Jun. 24, 2004

(65) Prior Publication Data

US 2005/0285809 A1 Dec. 29, 2005

(30) Foreign Application Priority Data

Jul. 2, 2003 (FR) ..... 03 08062

(51) Int. Cl.
*H01Q 13/10* (2006.01)

(52) U.S. Cl. ..... 343/767; 343/700 MS

(58) Field of Classification Search ..... 343/767, 343/700 MS, 768, 772
See application file for complete search history.

(56) References Cited

U.S. PATENT DOCUMENTS 5,081,466 A * 1/1992 Bitter, Jr. ..... 343/767
5,461,392 A * 10/1995 Mott et al. ..... 343/725
5,905,471 A * 5/1999 Biebl et al. ..... 343/769
6,292,153 B1 9/2001 Aiello et al.
6,657,600 B1 * 12/2003 Thudor et al. ..... 343/770

FOREIGN PATENT DOCUMENTS

| | | |
|---|---|---|
| EP | 1 267 446 | 12/2002 |
| EP | 1 267 661 | 1/2003 |
| GB | 749337 | 5/1956 |

* cited by examiner

*Primary Examiner*—Tan Ho
*Assistant Examiner*—Huedung X. Cao
(74) *Attorney, Agent, or Firm*—Joseph J. Laks; Robert D. Shedd; Brian J. Cromarty

(57) ABSTRACT

The invention proposes an antenna operating in two frequency bands and having two separate ports. The invention is a printed antenna with slot produced on a ground plane. Said antenna consisting of a slot 1, said antenna having a first port produced by a first microstrip line 2, the coupling between the first line 2 and the slot 1 being produced at a first distance L1 from a closed end of the slot, and a second port produced by a second microstrip line 4, the coupling between the second line 4 and the slot 1 being produced at a second distance L2 from the closed end of the slot. The invention also pertains to a system of antennas which comprises at least two twin-port antennas.

6 Claims, 3 Drawing Sheets

DUAL-BAND ANTENNA WITH TWIN PORT

The invention relates to an antenna working in two frequency bands and having two ports, one per band. More particularly, the antenna of the invention is a slot antenna having longitudinal radiation.

BACKGROUND OF THE INVENTION

The development of broadband wireless networks is experiencing such success that several standards coexist side by side. Among the various standards may be cited the Hiperlan2 and IEEE802.11a standards that operate in frequency bands situated at around 5 GHz and likewise the IEEE802.11b and IEEE802.11g standards that operate in frequency bands situated at around 2.4 GHz. The goal of these standards is to define communication norms between various types of appliances. A domestic network comprises for example television sets, video players, satellite or cable decoders, personal computers, as well as any other device needing to exchange data with one or more of the other aforesaid appliances. In order to assemble the domestic network, it is necessary for all the appliances to use one and the same communication norm. However, this might possibly not be the case for all the appliances and certain appliances will have to cater for multistandard compatibility.

In order to be multistandard, it is necessary to have circuits and antennas for receiving the corresponding signals. However, having as many antennas as usable frequency bands is not easy for a compact device.

BRIEF SUMMARY OF THE INVENTION

The invention proposes an antenna operating in two frequency bands and having two separate ports. Thus, the invention is a printed antenna with slot produced on a ground plane situated on a face of a substrate, said antenna consisting of a slot having an open end which radiates and a closed end, said antenna having a first port produced by a first microstrip line situated on an opposite face of the substrate to the ground plane, the coupling between the first line and the slot being produced at a first distance from the closed end of the slot, and a second port produced by a second microstrip line situated on an opposite face of the substrate to the ground plane, the coupling between the second line and the slot being produced at a second distance from the closed end of the slot, the second distance being different from the first distance.

Preferably, the first distance is between 1.5 and 2.5 times the second distance. The slot is provided with a resonant slot placed between the two ports, the resonant slot being tuned to the center frequency corresponding to the optimum coupling between the first line and the slot. A resonator is coupled to one of the microstrip lines, the resonator being tuned to the center frequency of the other port. The microstrip lines each have an open-circuit end linked to the ground plane by way of a diode.

The invention is also a system of antennas, which comprises at least two antennas as defined above.

BRIEF SUMMARY OF THE DRAWINGS

The invention will be better understood and other features and advantages will become apparent on reading the description which follows, the description making reference to the appended drawings among which.

DESCRIPTION OF PREFERRED EMBODIMENTS

Figure 1:
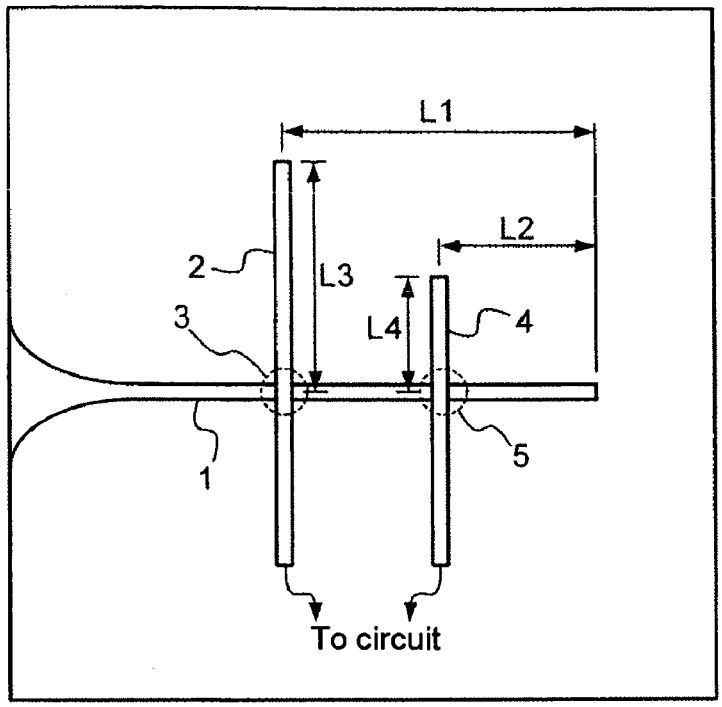
FIG. 1 represents an antenna according to the invention.

FIG. 1 represents a substrate having on a face a ground plane in which a slot 1 is fashioned. The substrate is for example a substrate marketed under the reference RO4003 of relative permittivity $\epsilon_r$=3.38 and of thickness 0.81 mm. The slot 1 is for example flared at the level of its radiating end. The flaring is done for example over a length of 37 mm with a radius of curvature of 45 mm. The slot 1 also has a closed end which behaves like a short circuit. The width of the slot is for example 0.4 mm so as to have a passband which encompasses the frequency bands corresponding to the IEEE802.11a and IEEE802.11b standards.

A first microstrip line 2 constitutes a first port of the slot antenna 1. The first microstrip line 2 is placed on the substrate on an opposite face to the ground plane. The first microstrip line 2 comprises an open-circuit end and an end conveying the signal to a reception circuit (not represented). The first microstrip line 2 is coupled to the slot in a first zone 3 situated at a distance L1 from the short-circuit end of the slot 1 and at a distance L3 from the open-circuit end of the first microstrip line 2.

A second microstrip line 4 constitutes a second port of the slot antenna 1. The second microstrip line 4 is placed on the substrate on an opposite face to the ground plane. The second microstrip line 4 comprises an open-circuit end and an end conveying the signal to a reception circuit (not represented). The second microstrip line 4 is coupled to the slot in a second zone 5 situated at a distance L2 from the short-circuit end of the slot 1 and at a distance L4 from the open-circuit end of the second microstrip line 4.

The passband of each port depends on the coupling between the slot 1 and each microstrip line 2 or 4. At the level of the first port, the distances L1 and L3 are fixed so as to ensure good coupling over the frequency band situated at 2.4 GHz. The distance L1 corresponds to a quarter of the wavelength guided in the slot 1 of frequency 2.4 GHz. The distance L3 corresponds to a quarter of the wavelength guided in the first microstrip line 2 of frequency 2.4 GHz. At the level of the second port, the distances L2 and L4 are fixed so as to ensure good coupling over the frequency band situated at 5 GHz. The distance L2 corresponds to a quarter of the wavelength guided in the slot 1 of frequency 5.5 GHz. The distance L4 corresponds to a quarter of the wavelength guided in the second microstrip line 4 of frequency 5.5 GHz.

The couplings being independent of one another, it is possible to use both ports simultaneously. The person skilled in the art might think that a transmission on one of the ports may saturate reception on the other port. However, the distance L1 is equal to around double the distance L2 and the distance L3 is equal to around double the distance L4 since one of the center frequencies of the two frequency bands is around double the other. On account of these distances it turns out that the coupling on the first port at a frequency situated in the 5 GHz band is almost zero since the distances L1 and L3 correspond substantially to half the wavelengths guided in the slot 1 and in the first microstrip line 2, this corresponding to very poor coupling and therefore good isolation. As far as the coupling on the second port at a frequency situated in the 2.4 GHz band is concerned, the coupling occurs under conditions that are not optimum thus creating a small isolation.

One could be satisfied with the example of FIG. 1 ideally when the distances are calculated so that one is double the other, corresponding to double frequencies. It is appreciated that it is possible to dispense with the ideal condition and to have a ratio of distances lying between 1.5 and 2.5, while retaining satisfactory isolation.

Figure 2:
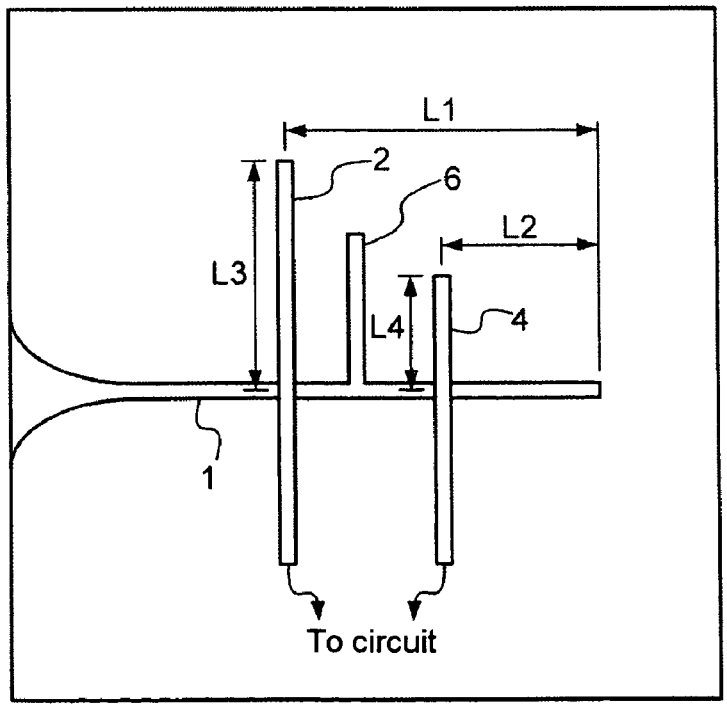
FIGS. 2 to 4 represent variant embodiments of the invention.

To improve the isolation on the second port, it is possible to add filtering means. Cunningly, the filtering means is integrated into the antenna. In FIG. 2, the slot 1 is provided with one or more lateral slots 6 placed between the two ports and dimensioned so as to trap the frequency of 2.4 GHz. The lateral slot 6 acts as a band rejection filter for the second port without disturbing the first port. These slots may be placed head-to-tail, or alongside one another. The use of several slots makes it possible to increase the rejection or to spread the rejection over a wider frequency band.

Figure 3:
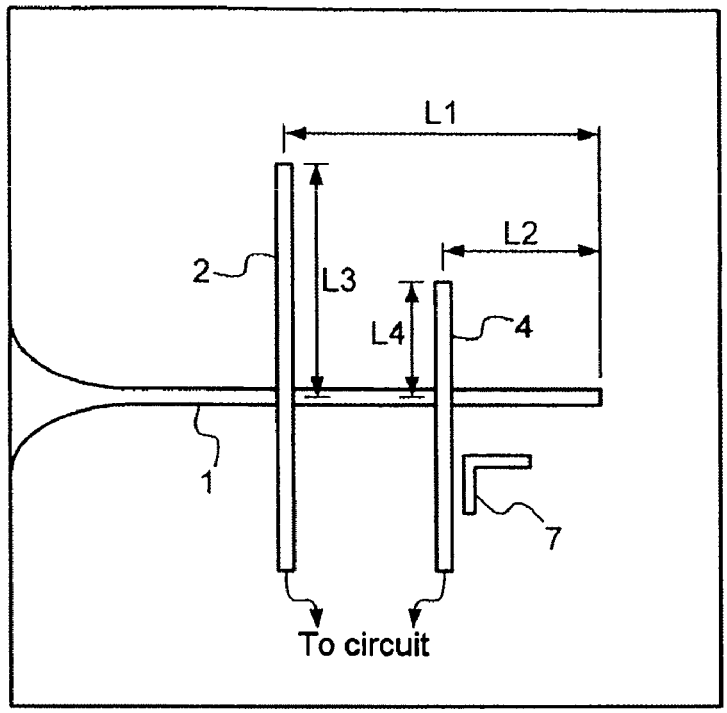
Figure 4:
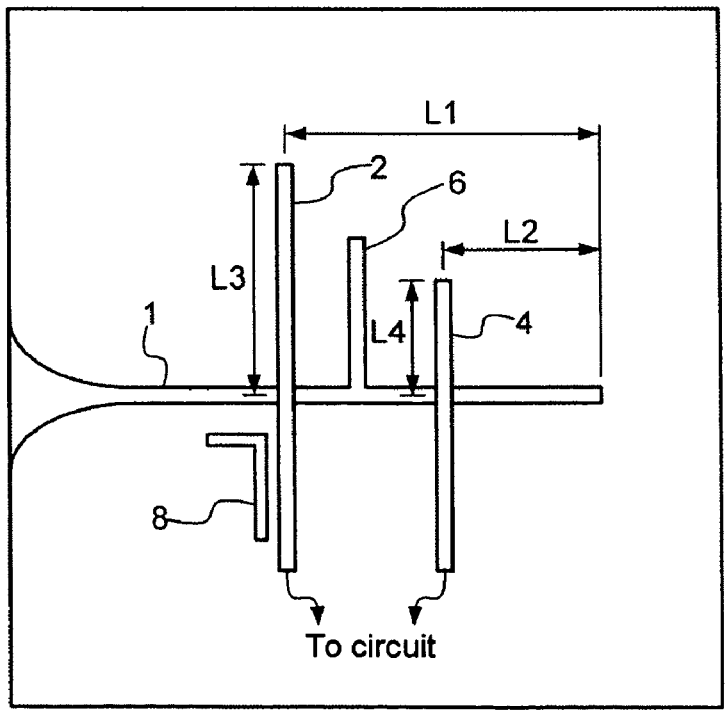

Another variant, FIG. 3, consists in coupling a resonator 7 to the second microstrip line 4. The resonator tuned to the frequency of 2.4 GHz then behaves as a band rejection filter for this frequency.

If the gap between the frequency bands that one wishes to obtain corresponds to a factor of 3, it is appreciated that the coupling conditions become ideal on both ports for the frequency band corresponding to the second port. A solution then consists in coupling a resonator 8 to the first microstrip line so as to trap and reject the undesired frequency. The resonator 8 can be used with or without filtering means on the second port.

Figure 5:
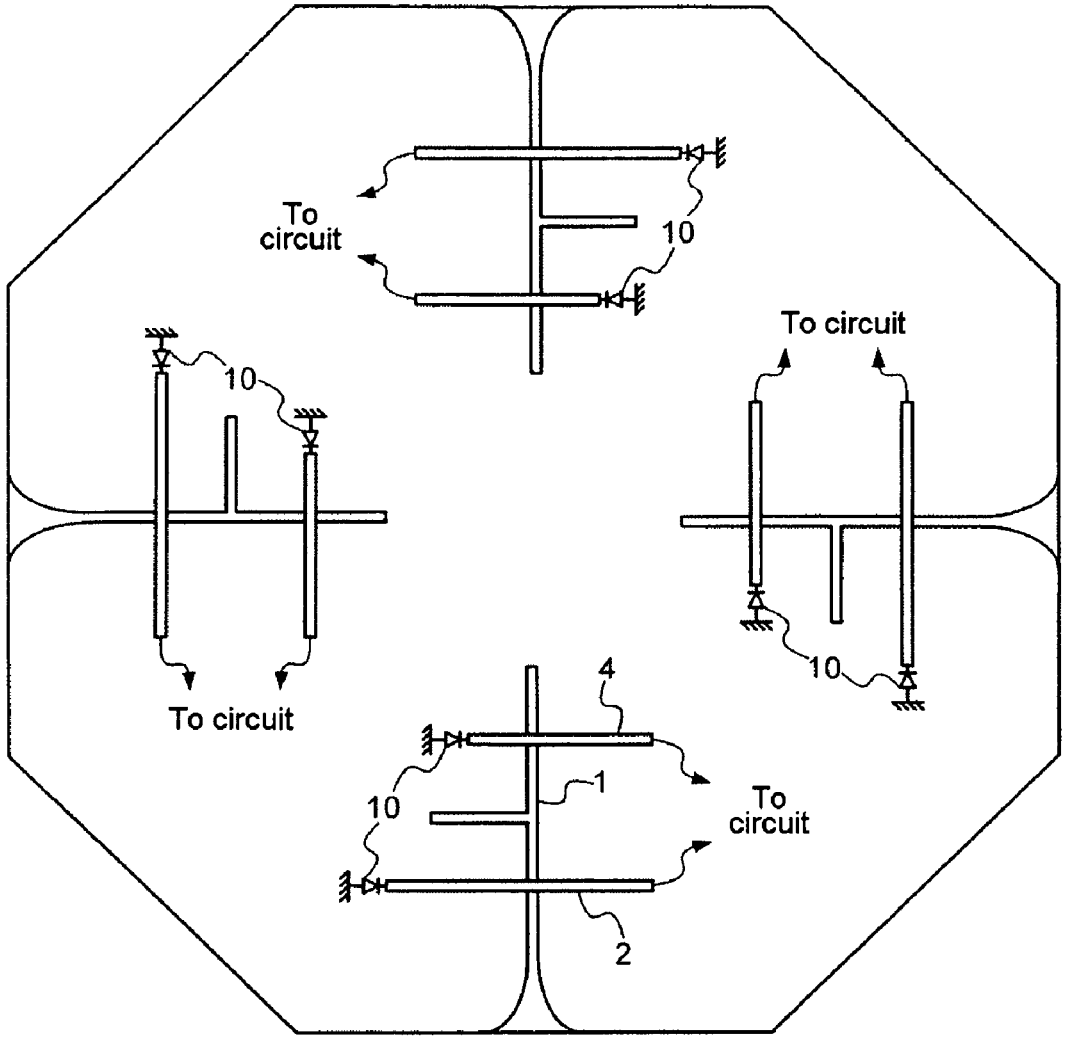
FIG. 5 represents a system of antennas comprising several antennas according to the invention.

The benefit of a twin-port antenna as described above is of being very compact and hence easily integratable. For systems operating according to IEEE802.11a, it is known to effect antenna diversity. Accordingly, it is possible to place several antennas on one and the same substrate as shown in FIG. 5. Each antenna can be switched with the aid of diodes 10 placed between the open-circuit end of the microstrip lines 2 and 4 and the ground plane. DC biasing of the microstrip line makes it possible to enable or disable the port depending on the bias of each diode 10. It is possible to switch the first and second ports of the antennas independently.

The embodiments describe a system with two ports. However, the concept of using several ports on the same slot can be generalized to more than two antennas. Since the optimum case can no longer occur when more than two ports are employed, it is still possible to place resonators on each port so as to reject the frequencies corresponding to the other ports.

What is claimed is:

1. A printed antenna working in two frequency bands, said antenna consisting of a slot and produced on a ground plane situated on a face of a substrate having an open end which radiates and a closed end, said antenna having a first port produced by a first microstrip line situated on an opposite face of the substrate to the ground plane, the coupling between the first line and the slot being produced at a first distance from the closed end of the slot, said first port forming an access for one frequency band wherein the antenna has a second port produced by a second microstrip line situated on an opposite face of the substrate to the ground plane, the coupling between the second line and the slot being produced at a second distance from the closed end of the slot, said second port forming an access for the other frequency band, the second distance being different from the first distance.

2. The antenna as claimed in claim 1, wherein the first distance is between 1.5 and 2.5 times the second distance.

3. The antenna as claimed in claim 1, wherein the slot is provided with a resonant slot placed between the two ports, the resonant slot being tuned to the center frequency corresponding to the optimum coupling between the first line and the slot.

4. The antenna as claimed in claim 1, wherein at least one resonator is coupled to one of the microstrip lines, the resonator being tuned to the center frequency of the other port.

5. The antenna as claimed In claim 1, wherein the microstrip lines each have an open-circuit end linked to the ground plane by way of a diode.

6. A system of antennas, characterized in that it comprises at least two antennas as claimed in claim 1.

* * * * *